US007045197B2

(12) United States Patent
Harris

(10) Patent No.: US 7,045,197 B2
(45) Date of Patent: May 16, 2006

(54) SELF-MEASURING ROLL GOODS

(76) Inventor: David N. Harris, 15274 Camino del Parque, Sonora, CA (US) 95370

( * ) Notice: Subject to any disclaimer, the term of this patent is extended or adjusted under 35 U.S.C. 154(b) by 0 days.

(21) Appl. No.: 10/458,861

(22) Filed: Jun. 11, 2003

(65) Prior Publication Data

US 2004/0253416 A1 Dec. 16, 2004

(51) Int. Cl.
*B32B 3/16* (2006.01)
*G01B 3/10* (2006.01)

(52) U.S. Cl. ..... 428/195.1; 428/906; 428/207; 33/733; 33/494; 33/566; 33/1 B; D10/70; D10/71; D10/72; D6/582; D5/58

(58) Field of Classification Search ..... 428/195.1, 428/207, 906; 33/733, 494, 566, 1 B; D10/70, D10/71, 72; D6/582; D5/58
See application file for complete search history.

(56) References Cited

U.S. PATENT DOCUMENTS

| | | | | | |
|---|---|---|---|---|---|
| 1,116,918 | A * | 11/1914 | Putnam et al. | 33/1 F |
| 2,369,988 | A * | 2/1945 | Steckler | 434/187 |
| 3,398,680 | A * | 8/1968 | Moskowitz | 101/115 |
| 4,827,621 | A | 5/1989 | Borsuk | 33/758 |
| 4,924,644 | A | 5/1990 | Lewis | 52/105 |
| 4,927,696 | A | 5/1990 | Berg | 428/195 |
| 5,452,523 | A * | 9/1995 | Jansen | 33/555.4 |
| 5,673,489 | A | 10/1997 | Robell | 33/1 B |
| 5,950,319 | A | 9/1999 | Harris | 33/494 |
| 6,049,987 | A | 4/2000 | Robell | 33/1 B |
| 6,115,926 | A | 9/2000 | Robell | 33/1 B |
| D456,148 | S * | 4/2002 | Giombini | D5/58 |
| 2002/0148134 | A1 * | 10/2002 | Meyer et al. | 33/758 |

* cited by examiner

*Primary Examiner*—William P. Watkins, III
(74) *Attorney, Agent, or Firm*—Henneman & Saunders; Larry E. Henneman, Jr.

(57) ABSTRACT

Self measuring roll goods includes a pliable substrate, a front surface, and a rear surface. The rear surface includes fiducial markings to facilitate the quick and easy measurement of the roll goods. The fiducial markings include an array of symbols, and at least a portion of the peripheral edges of the symbols are spaced apart from the peripheral edges of adjacent symbols. The pitch of the array defines a gross measurement scale. In a particular embodiment, the peripheral edges of the symbols intersect tangentially. In another particular embodiment, the symbols are completely spaced apart. Examples of the symbols include closed curves, polygons, and linear symbols. Optionally, marks on the perimeters of the symbols and/or the vertices of the symbols provide a fine measurement scale.

30 Claims, 7 Drawing Sheets

SELF-MEASURING ROLL GOODS

BACKGROUND OF THE INVENTION

1. Field of the Invention

The present invention relates generally to devices and methods for measuring construction materials, and more particularly to measuring rolled construction materials. Even more particularly, the present invention relates to a marking scheme for rolled construction materials that facilitates quick and easy measurement of rolled construction materials.

2. Description of the Background Art

In the use of rolled construction materials (e.g., carpet, linoleum, roofing material, etc.) it is necessary to cut pieces of the material of desired lengths from supply rolls. Sometimes, sheets are cut from rolls in a warehouse. Other times, pieces are cut from rolls in the field, sometimes under less than optimal conditions, for example in the back of a carpeting van.

Many devices exist for measuring roll goods. For example, in warehouses mechanical roll meters are typically used to measure materials as they are pulled from rolls. Another way roll goods are measured is to roll the material out on a large flat surface, and measure the piece with a conventional tape measure. However, in the field, special devices like roll meters are sometimes not available. Further, it is sometimes inconvenient or impractical to roll out very large pieces of material flat for measurement. In any case, measurement with existing tools is inconvenient and time consuming, and there is a cost associated with such tools.

Marking schemes have been developed to facilitate the measurement of construction materials without tools. One such marking scheme is disclosed in U.S. Pat. No. 5,673,489 by Robell, and is shown in FIG. 1 for convenience. According to this marking scheme, a measurement grid is printed directly on the back of each piece of construction material (e.g., wallboard, plywood, etc.). The grid includes a measurement scale along at least one edge of the material whereby the relative positions of the lines of the grid can be identified.

Such measurement grids suffer from at least two disadvantages. First, once a piece is cut from the material, the measurement scale is no longer accurate for subsequently cut pieces from the same piece of material. This is perhaps why such grid systems have never been applied to roll goods, where many pieces are typically cut from the same roll. Second, these measurement grids are hard to look at, and tend to make the user's eyes "swim". In other words, the blocks of the grid tend to run together, and are very difficult to count. Indeed, given the measurement scales marked on these grids, it is clear that the squares of the grids were never intended to be counted.

What is needed is a system and method for quickly measuring roll goods, without any measuring devices. What is also needed is a system and method for measuring roll goods that can be used to measure pieces from previously cut rolls.

SUMMARY

The present invention overcomes the problems associated with the prior art by providing roll goods with fiducial markings that are easily discernable to a user. The invention facilitates quick and easy measurement of roll goods, without the use of a measuring device.

The roll goods include a pliable substrate, a front surface, and a rear surface. The rear surface has fiducial markings thereon to facilitate the measurement of material from the roll. The fiducial markings include an array of symbols, and at least a portion of the peripheral edges of the symbols are spaced apart from the peripheral edges of adjacent symbols. In a particular embodiment, the peripheral edges of adjacent symbols intersect tangentially. In an alternate embodiment, the symbols are completely spaced apart. The shape of the spaces between adjacent symbols is different from the shapes of the symbols themselves, thereby making the symbols easily discernible from one another.

The pitch of the array of symbols defines a gross measurement scale. In a particular embodiment, the size of at least a portion of the symbols correspond to the gross measurement scale.

Optionally, a fine measurement scale is also provided. In one embodiment, the symbols are shapes (e.g., closed curves, polygons, etc.), and marks on the perimeters of the shapes define the fine measurement scale. In another embodiment, the symbols are polygons, and the vertices of the polygons define the fine measurement scale.

In some embodiments, the symbols include more than one shape. For example, in one particular embodiment the symbols include a first shape disposed within a second shape. In a particular embodiment, the first shape is a circle, and the second shape is a polygon. In an even more particular embodiment, the diameter of the circle corresponds to the gross scale, and the polygon is concentric with the circle and has a height equal to one third the diameter of the circle.

In another embodiment, the fiducial markings include two types of symbols, each having a size corresponding to the gross scale. The symbols are arranged in an array such that the different type symbols are disposed adjacent one another. In an alternate embodiment, the symbols are linear symbols, and symbols in adjacent rows have a different angular orientation to make them more discernible from one another.

In some embodiments, the height of at least some of the symbols is different than the width of the symbols. In one particular embodiment the fiducial markings include a plurality of columns, each column having a plurality of symbols of a particular height. In a more particular embodiment, the height of the symbols of each particular column correspond to a different measurement scale than the other columns.

Those skilled in the art will understand that various embodiments of the invention described herein will achieve some, but not necessarily all, of the advantages described herein. Further, embodiments including certain features of the invention may be more advantageous in particular applications, whereas other embodiments with different features may be more advantageous in other circumstances. Accordingly, no single feature is considered to be an essential element of the invention, and thus should not be construed as a limitation unless expressly recited in a particular claim.

BRIEF DESCRIPTION OF THE DRAWINGS

The present invention is described with reference to the following drawings, wherein like reference numbers denote substantially similar elements.

DETAILED DESCRIPTION

The present invention overcomes the problems associated with the prior art, by providing a system and method for marking roll goods that facilitates quick and easy measurement of materials off of a roll. In the following description, numerous specific details are set forth (e.g., types of roll goods, width of rolls, etc.) in order to provide a thorough understanding of the invention. Those skilled in the art will recognize, however, that the invention may be practiced apart from these specific details. In other instances, details of well known material manufacturing practices (e.g., material fabrication, application of markings, etc.) and equipment have been omitted, so as not to unnecessarily obscure the present invention.

The inventor has determined that the measurement scales provided with prior art marking schemes could be omitted, if the cells of the grid could be quickly and easily counted. The inventor has further determined that the geometric characteristics of known grid systems are responsible for the difficulty in viewing and counting the blocks of a grid. The following embodiments of the present invention illustrate marking schemes that overcome the problems of the prior art, thereby making the marking schemes of the present invention suitable for use on roll goods.

Figure 1:
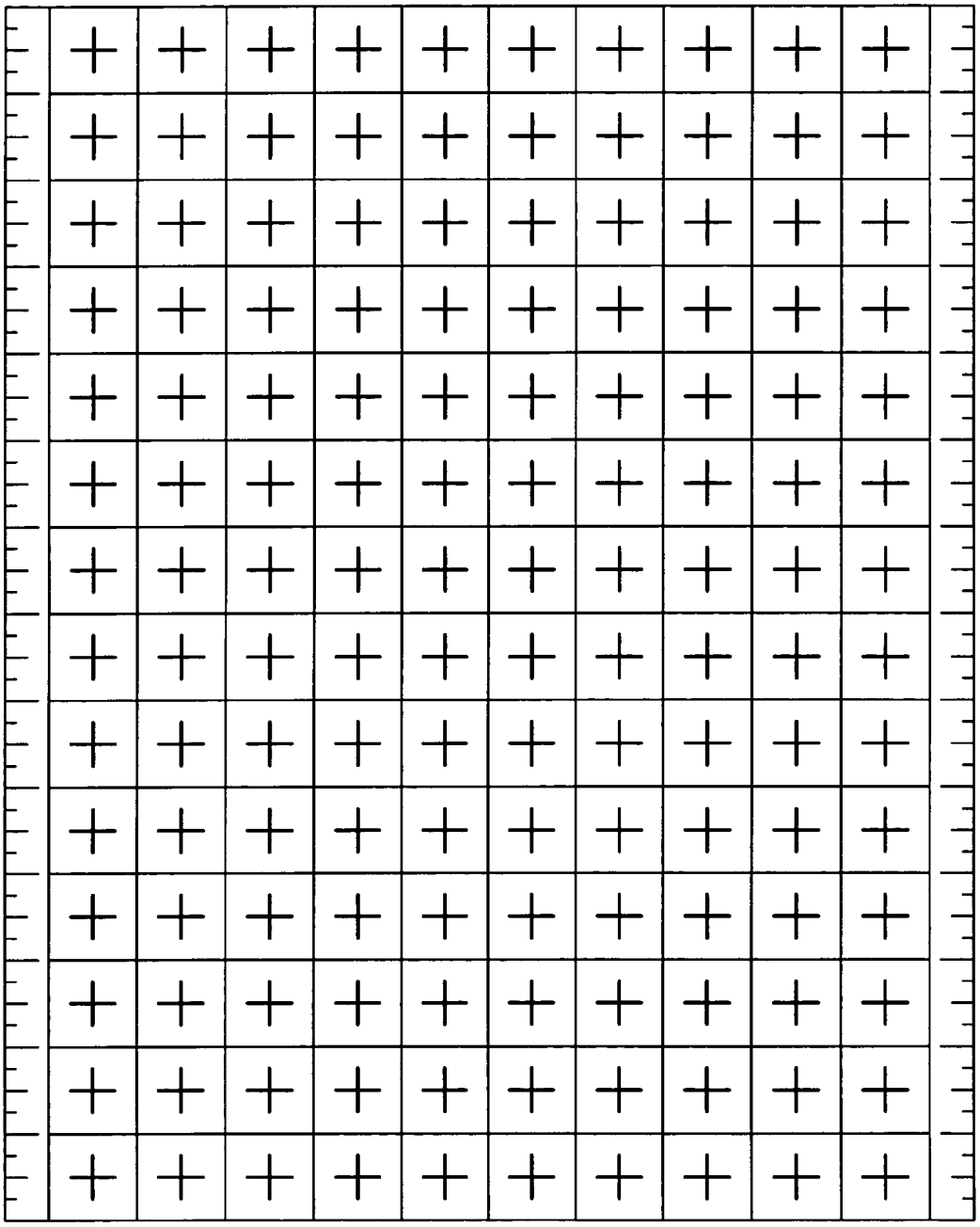
FIG. 1 shows a prior art measuring system for construction materials.
Figure 2:
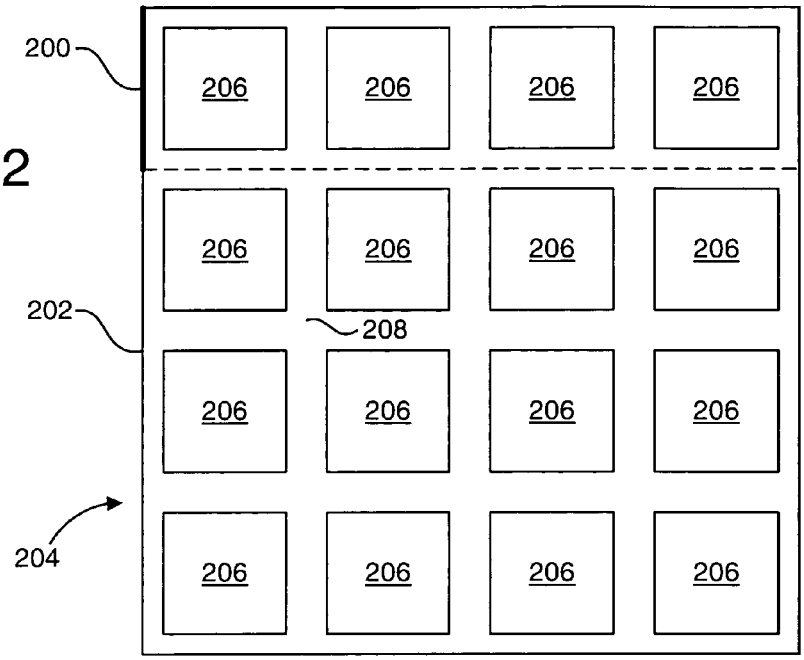
FIG. 2 shows a roll of material with fiducial markings applied thereto according to the present invention.

FIG. 2 shows a roll 200 of material 202 that includes fiducial markings 204 to facilitate the quick and easy measurement of pieces of material 202 from roll 200. For purposes of explanation, the width of roll 200 will be considered to be 12 feet, which is standard in the U.S. carpet industry. It should be understood however, that the present invention can be used with rolls of any width, as well as with other types of roll goods (e.g., other floor coverings, roofing materials, etc.).

Fiducial markings 204 include an array of symbols 206 (squares) that are spaced apart from one another. The fact that at least a portion of the edges of the symbols are spaced apart from one another makes the symbols easier to count than in the prior art. Note also that the shape of the spacing 208 between adjacent symbols 206 is different than the shapes of symbols 206 themselves. These features make it much easier to clearly distinguish adjacent symbols from one another when counting.

The pitch of the array of symbols 206 defines a gross measurement scale, that is very much larger that the measurement scales of the prior art. Prior art marking grids intended for measuring piece goods (e.g., plywood) have a much finer scale, on the order of an inch or less. Such fine scale grids would be virtually impossible to quickly and easily read when cutting roll goods. Indeed, such a fine scale is unnecessary on roll goods, because pieces are typically "rough cut" from rolls. For example, according to standard practice, pieces of carpet are cut slightly larger than the actual dimensions of the floor to be covered. Then, the fine trimming is done in place on the actual floor being covered during installation.

Keeping the pitch of the array large, makes it easier to count the symbols 206, and thus easier to measure the roll goods. In the example of FIG. 2, the pitch of the array is 3 feet. Thus, if a worker needed to cut 30 feet from roll 200, he would need only count 10 large squares, and make the cut.

Those skilled in the art will understand that the pitch of the array may be altered without deviating from the scope of the invention. For example, pitches of 2 feet, 4 feet, or greater could be used, depending on the particular application. The choice of a particular pitch will depend at least in part on the width of the roll, and the inventor has found that a pitch of at least one-eighth the width of the roll, a pitch of at least one-sixth the width of the roll, or a pitch of at least one-fourth the width of the roll work particularly well.

Figure 3:
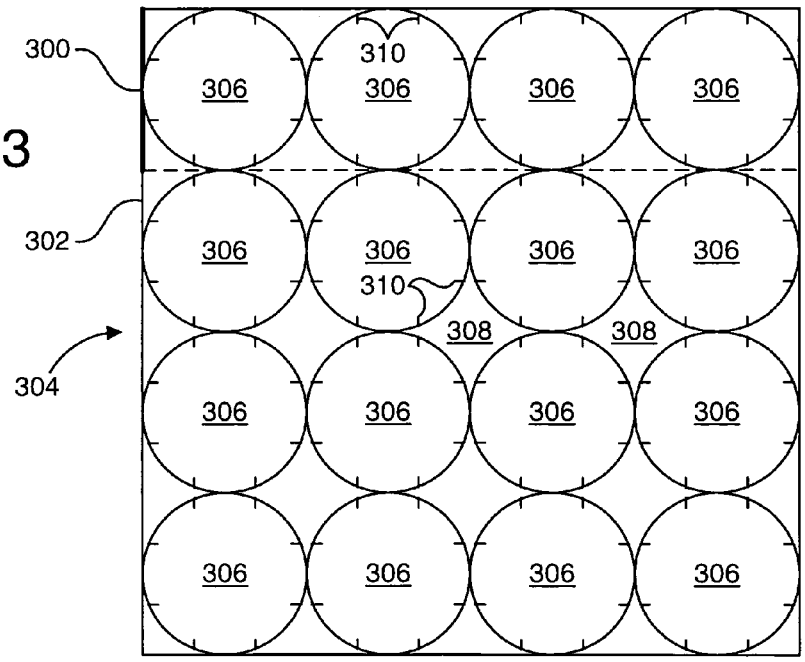
FIG. 3 shows another roll of material with fiducial markings applied thereto according to the present invention.

FIG. 3 shows a roll 300 of material 302 that includes fiducial markings 304 according to another particular embodiment of the present invention. Markings 304 includes an array of symbols 306 (circles). Although circles 306 are not completely spaced apart from one another, their perimeters intersect tangentially, such that the shapes of the spaces 308 between circles 306 is different than the shapes of circles 306. Thus, adjacent ones of circles 306 are easily discernable, and therefore easy to count.

As in the previous embodiment, the pitch of the array of circles 306 defines a gross scale. However, fiducial markings 304 also include a fine scale. In particular, each of circles 306 includes a plurality of tick marks 310 disposed around their perimeters. Incorporating the tick marks into the perimeter of symbols 306 makes the fine scale much less likely to obscure the separation between symbols 306, providing a significant advantage over the grid systems of the prior art.

In this example, circles 306 have a diameter of 3 feet. Tick marks 310 are disposed to divide each circle 306 into thirds both vertically and horizontally. Thus, material 302 can be easily measured and cut at any desired one foot increment. For example, to cut 10 feet of material 302 from roll 300, the worker would simply count 3 circles and 1 tick mark.

Figure 4:
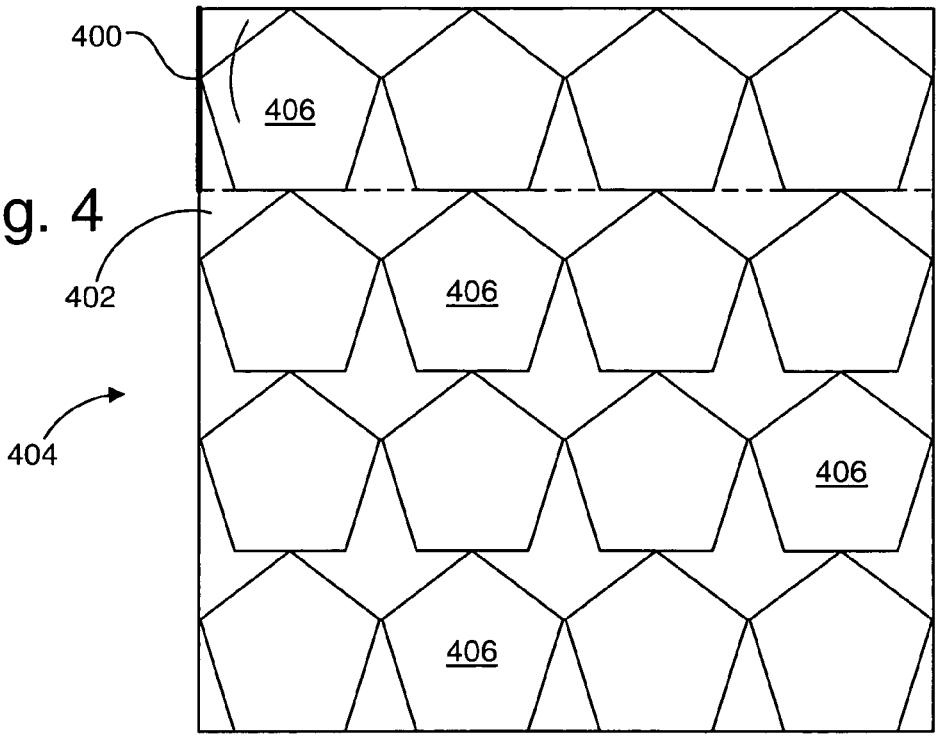
FIG. 4 shows another roll of material with fiducial markings applied thereto according to the present invention.

FIG. 4 shows a roll 400 of material 402 that includes fiducial markings 404 according to another particular embodiment of the present invention. Fiducial markings 404 include an array of polygons 406 (pentagons in this example), the pitch of which defines a gross measurement scale. Note that adjacent polygons 406 intersect only tangentially, and are easily discernable from one another. In an alternate embodiment (not shown) every other row of polygons 406 could be offset to make adjacent polygons 406 even more clearly distinguishable.

Figure 5:
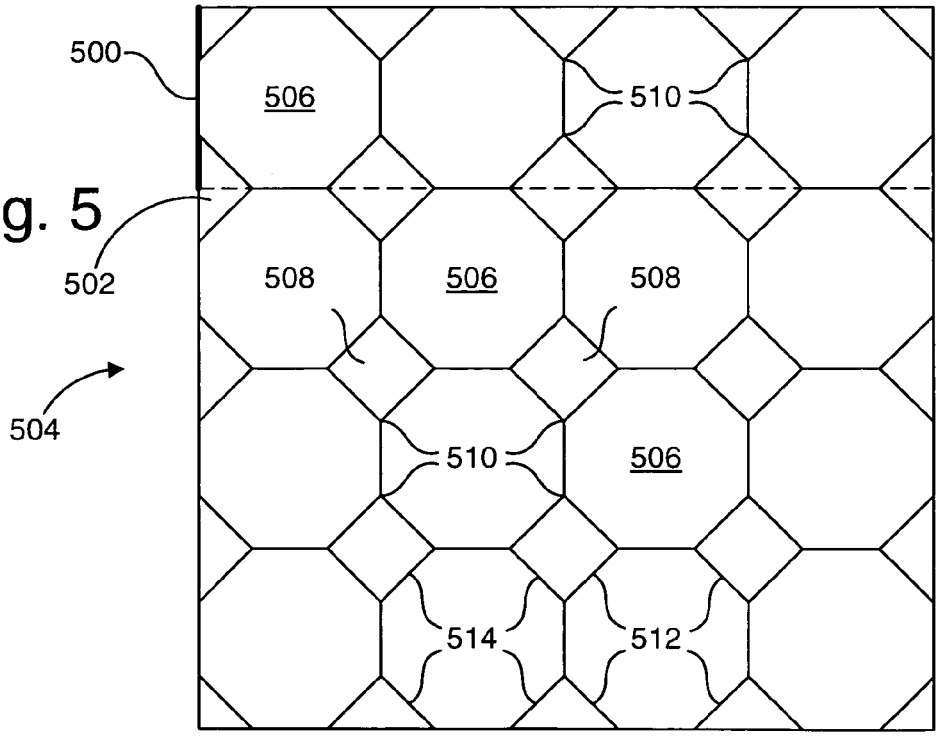
FIG. 5 shows another roll of material with fiducial markings applied thereto according to the present invention.

FIG. 5 shows a roll 500 of material 502 that includes fiducial markings 504 according to another particular embodiment of the present invention. Fiducial markings 504 are similar to fiducial markings 304, except that fiducial markings 504 include an array of polygons 506 (octagons in this example) instead of circles 306. Note that the shapes 508 between polygons 506 are different than polygons 508, again making polygons 508 easily discernable from one another, and thus easy to count.

Another difference between fiducial markings 304 and fiducial markings 504 is that tick marks 310 are omitted. Instead, polygons 506 are shaped such that their vertices 510 define a fine scale (one foot in this example). To obtain the one foot fine scale, each of polygons 506 are three feet in height and width, the horizontal and vertical sides 512 are each one foot in length, and the oblique sides 514 are $\sqrt{2}$ feet in length. If an even finer scale is desired, polygons having more sides can be substituted for octagons 506.

Figure 6:
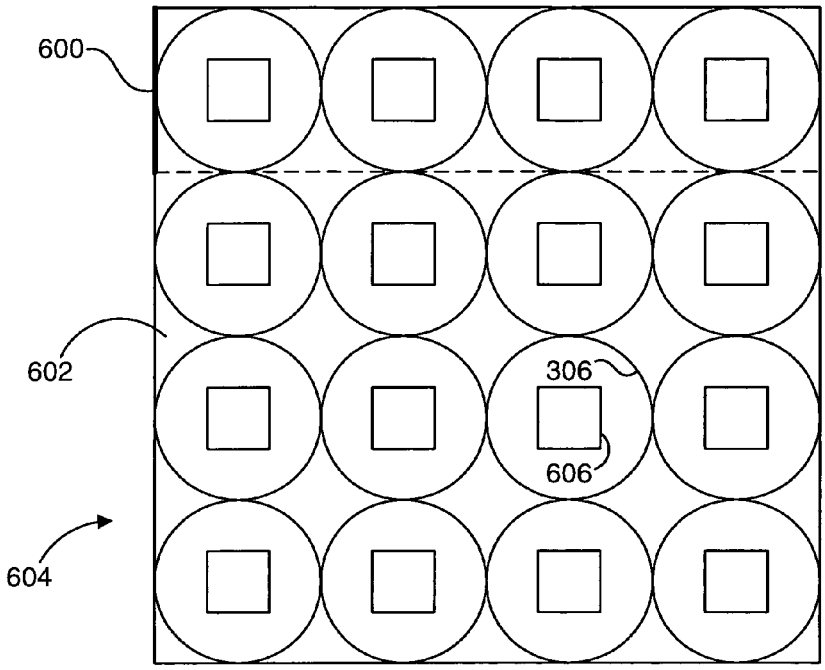
FIG. 6 shows another roll of material with fiducial markings applied thereto according to the present invention.

FIG. 6 shows a roll 600 of material 602 that includes fiducial markings 604 according to another particular embodiment of the present invention. Fiducial markings 604 are similar to fiducial markings 304, except that tick marks 310 are replaced by polygons 606 disposed within circles 306, in order to define a fine scale. In this particular embodiment, polygons 606 are one foot squares that are each concentric with a respective one of circles 306. Thus, in order to measure a thirteen foot piece of material 602 from roll 604, a worker would count four circles 306 (twelve feet) and then cut along the bottom edges of squares 606 of the next row.

Those skilled in the art will recognize that variations of the shape within a shape pattern of FIG. 6 are also useful. For example, the inner shapes can be the same as the outer shapes (circles within circles, polygons within polygons, etc.). As another example, more that one shape can be disposed within a larger shape (multiple squares within a circle, different shapes within the same circle, etc.). Further, the inner and outer shapes need not be concentric. These and other variations will be apparent to one skilled in the art, in view of this disclosure.

Figure 7:
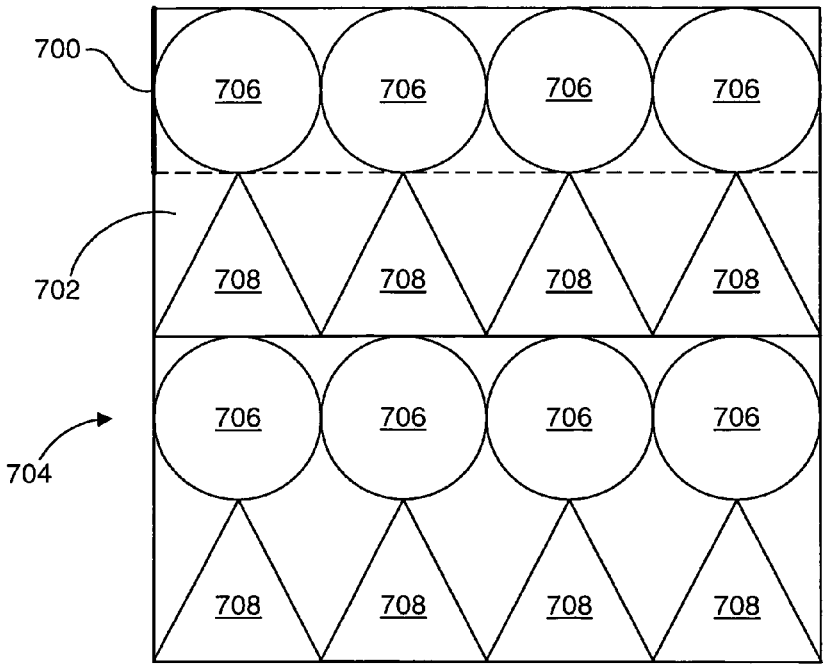
FIG. 7 shows another roll of material with fiducial markings applied thereto according to the present invention.

FIG. 7 shows a roll 700 of material 702 that includes fiducial markings 704 according to yet another particular embodiment of the present invention. Fiducial markings 704 include alternating rows of circles 706 and triangles 708. Fiducial markings 704 illustrate that more than one type of symbol can be used to define the gross measurement scale. This feature facilitates even faster measurement (counting). For example, if circles 706 and triangles 708 are both three feet in height, then counting circles (or triangles) vertically, allows a user to count in six foot increments. Even if the user prefers to count in three foot increments, the alternating shapes are easier to discern from one another, and thus easier to count.

In this particular example, fiducial markings 704 include circles and triangles. However, is should be apparent to one skilled in the art the different shapes can be used. Furthermore, it should be understood that more than two types of shapes can be used in a single pattern (e.g., circles, squares, triangle, . . . ).

Figure 8:
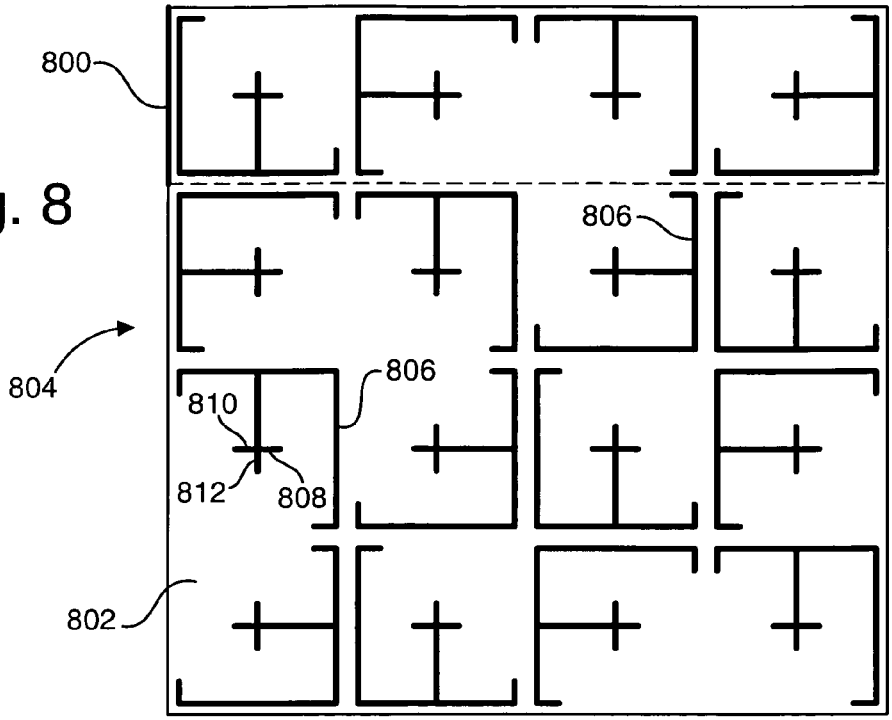
FIG. 8 shows another roll of material with fiducial markings applied thereto according to the present invention.

FIG. 8 shows a roll 800 of material 802 that includes fiducial markings 804 according to yet another particular embodiment of the present invention. Fiducial markings 804 illustrate that in addition to the shape symbols (polygons and closed curves) previously shown, linear type symbols 806 can be used with the present invention. Note that the pitch of the array defines a gross measurement scale, and that the cross features 808 of symbols 806 define a fine scale. In particular, the center of the cross is disposed in the center of the symbol, and therefore are spaced a distance of three feet (the pitch of the array) from one another. Further, each cross member 810 is one foot in length, and the terminal end 812 of each cross feature 808 extends six inches from the center of the respective cross feature 808. Thus, the tips of cross features 808 define a one foot fine measurement scale.

Note also that while each of linear symbols 806 is identical, each adjacent symbol 806 is rotated 90 degrees, to make adjacent symbols more clearly discernible from one another, and thus easier to count.

Figure 9:
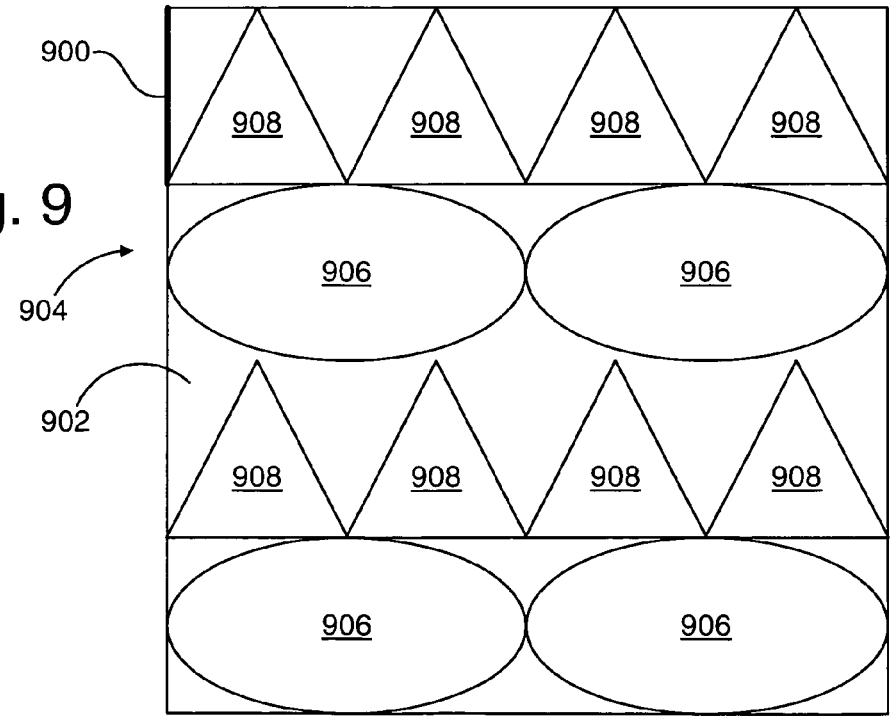
FIG. 9 shows another roll of material with fiducial markings applied thereto according to the present invention.

FIG. 9 shows a roll 900 of material 902 that includes fiducial markings 904 according to yet another particular embodiment of the present invention. Fiducial markings 904 include alternating rows of closed curves (ellipses in this particular example) 906 and polygons (triangles in this example) 908. Fiducial markings 904 illustrate that symbols having different horizontal and vertical dimensions can be used in fiducial marking patterns. The larger symbols are easy to discern from one another, and thus easy to count. The contrast between the sharp edges of polygons 908 and the smooth edges of ellipses 906 further contribute to ease of counting.

Figure 10:
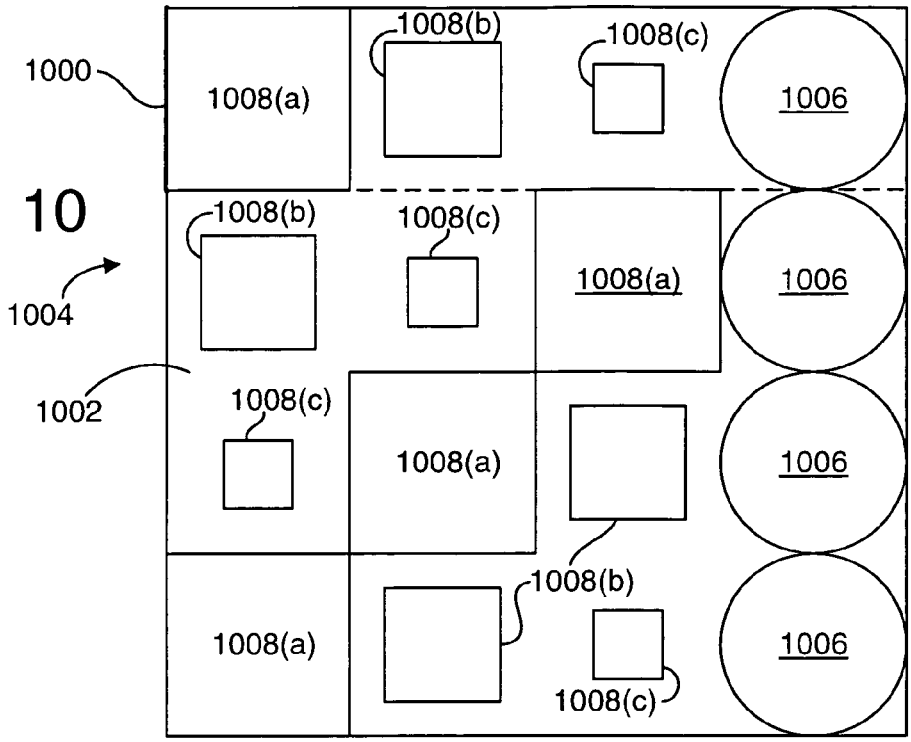
FIG. 10 shows another roll of material with fiducial markings applied thereto according to the present invention.

FIG. 10 shows a roll 1000 of material 1002 that includes fiducial markings 1004 according to yet another particular embodiment of the present invention. Fiducial markings 1004 illustrate additional aspects of the present invention. First, markings 1004 include a reference column of shapes 1006 (circles in this particular embodiment) along the right edge of material 1002. Fiducial markings 1004 further includes an array of polygons 1008(*a–c*) (squares in this particular embodiment) of varying sizes. The sizes of circles 1006 and squares 1008(*a*) define a gross measurement scale. The sizes of squares 1008(*b*) and 1008(*c*) define a fine measurement scale. In this particular embodiment circles 1006 have a diameter of three feet. Similarly, squares 1008(*a*) are three feet in length and width. Squares 1008(*b*) are two feet in length and width, and squares 1008(*c*) are one foot in length and width. Note that in each adjacent row, squares 1008(*a–c*) are shifted with respect to the previous row.

Figure 11:
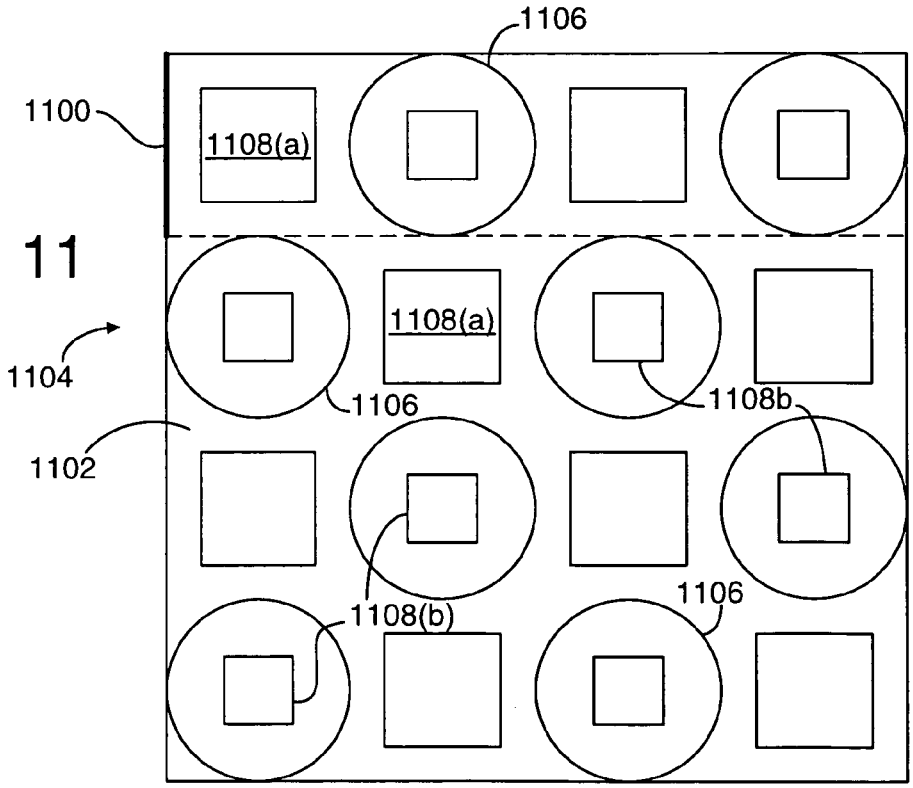
FIG. 11 shows another roll of material with fiducial markings applied thereto according to the present invention.

FIG. 11 shows a roll 1100 of material 1102 that includes fiducial markings 1104 according to yet another particular embodiment of the present invention. Fiducial markings 1104 include and array of symbols that combines aspects of previously described embodiments. The gross scale is defined by a plurality of circles 1106, which in this embodiment have a three foot diameter. A finer scale is defined by a pluralities of squares 1108(*a*) and 1108(*b*).

Note that squares 1108(*b*) are disposed concentrically within circles 1106, and that each row is offset by one pitch of the array. This provides two advantages. First, when counting up a column or across a row, the symbols alternate between squares 1108(*a*) and circles 1106. Second, disposing squares 1108(*b*) in circles 1106 saves space, and ensures that every row includes at least two each of squares 1108(*a*) and 1108(*b*). This provides at least two reference points for a cut line.

Figure 12:
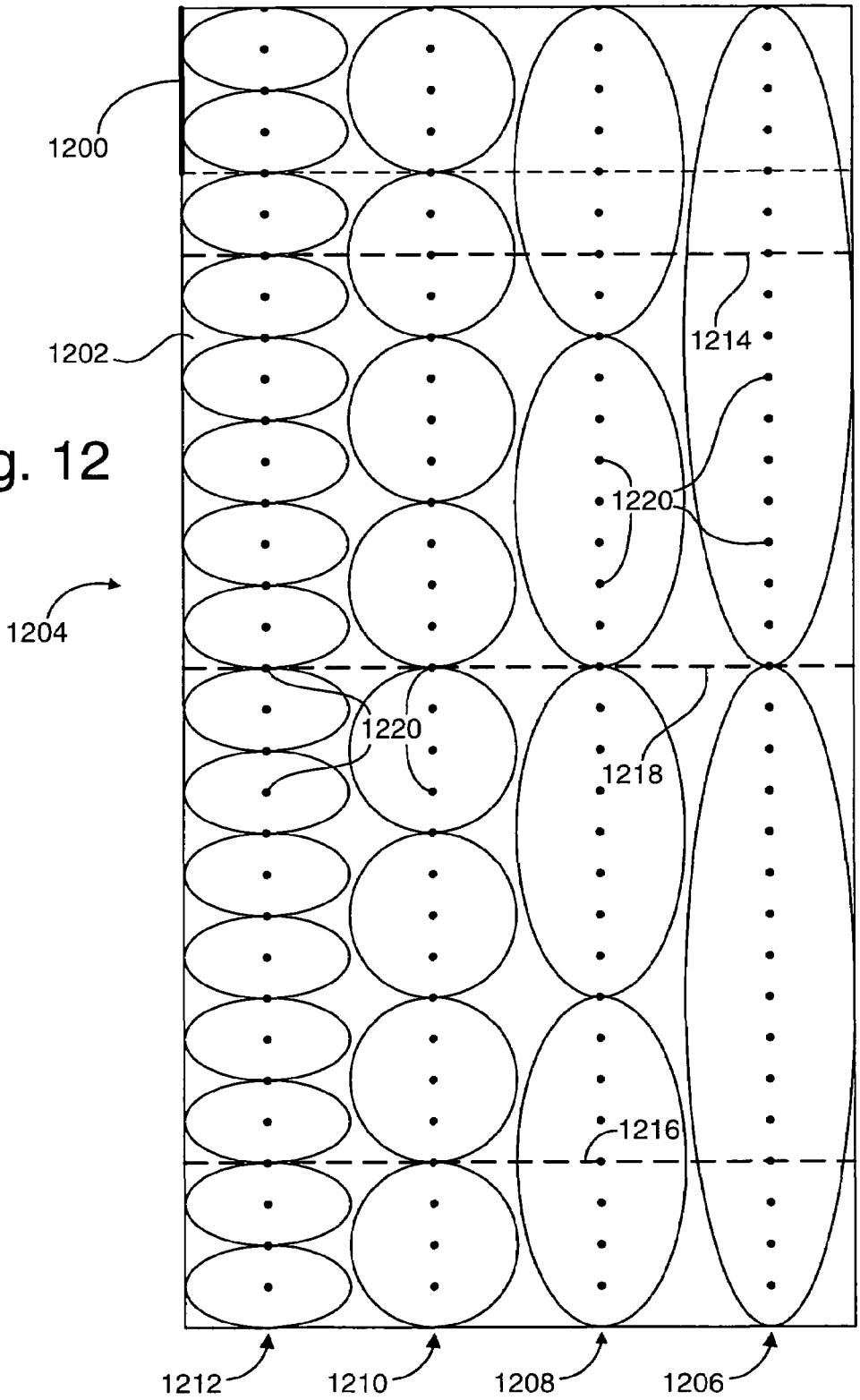
FIG. 12 shows another roll of material with fiducial markings applied thereto according to the present invention.

FIG. 12 shows a roll 1200 of material 1202 that includes fiducial markings 1204 according to yet another embodiment of the present invention. Fiducial markings 1204 include a plurality of symbols arranged in a plurality of columns. The symbols in each adjacent column have a progressively smaller vertical dimension. In particular, the symbols of each adjacent column are one-half the vertical length of the symbols of the preceding column. For example, in this particular embodiment, a first column 1206 includes symbols that are eight feet long, a second column 1208 includes symbols that are 4 feet in length, a third column 1210 includes symbols that are two feet in length, and a fourth column includes symbols that are one foot in length. This provides several scales by which roll material 1202 can be measured.

Fiducial markings 1204 can be used to quickly measure a piece of material 1202 from roll 1200 as follows. Assume for example that a thirteen foot piece of material is needed. A worker would begin counting up column 1206, counting eight feet for the first symbol. Then, because an additional eight feet would exceed the desired length, counting proceeds up column 1208, adding four feet for the next symbol to obtain a total of twelve feet. Then, because an additional four feet or an additional two feet would cause the total measurement to exceed the desired length, counting proceeds up column 1212, adding one foot for the next symbol to obtain a total measurement of thirteen feet. Because thirteen feet is the desired material length, material 1202 is cut just above the first counted symbol in column 1212, along dashed line 1214.

Measuring from roll 1200 after pieces of material 1202 have been cut from it is only slightly more difficult. For example, assume that material 1202 has been previously cut at line 1216, and that a twenty-two foot piece is desired. First, the user would measure down from the top of the first partial symbol in column 1206 (line 1218) to the cut edge 1216 of material, by counting the symbols in columns 1208 and/or 1210, to determine that the distance from line 1216 to line 1218 is six feet. Next, the six foot length is subtracted from the desired length of twenty-two feet obtain the additional length (sixteen feet) of material 1202 needed. Finally, the user counts up sixteen feet (two column 1206 symbols) from line 1218, and makes the cut.

Fiducial markings 1204 further include an array of reference marks 1216 (dots in this particular example) to help facilitate a straight cut. In particular, each column of symbols includes a column of reference dots 1216 up its center. In this particular embodiment, dots 1216 are spaced six inches apart. Note that, as in previously described embodiments, this relatively fine scale does not obscure the discernability of the symbols of fiducial markings 1204.

The description of particular embodiments of the present invention is now complete. Many of the described features may be substituted, altered or omitted without departing from the scope of the invention. For example, alternate symbols (e.g., diamonds, dog-bone, etc.), may be substituted for the shapes shown. As another example, the present invention can be applied to roll goods other than the types specifically disclosed herein. Further, although the invention has been described with reference to twelve foot wide roll goods, the invention is equally applicable to roll goods of different widths. These and other deviations from the particular embodiments shown will be apparent to those skilled in the art, particularly in view of the foregoing disclosure.

I claim:

1. Manufactured roll goods comprising:
a pliable substrate;
a leading edge across the width of said roll goods;
a side edge along the long dimension of said roll goods;
a front surface; and
a rear surface having fiducial markings thereon, said fiducial markings including an array of symbols, at least a portion of peripheral edges of said symbols being spaced apart from peripheral edges of adjacent symbols, and wherein
a pitch of said array defines a gross measurement scale;
said fiducial markings are substantially free of grid lines; and
said symbols include a circle having a diameter corresponding to said gross measurement scale and a polygon disposed within said circle, said polygon being concentric with said circle and having a height equal to one third the diameter of said circle.

2. Manufactured roll goods according to claim 1, wherein said peripheral edges of said symbols intersect tangentially.

3. Manufactured roll goods according to claim 1, wherein said symbols are completely spaced apart.

4. Manufactured roll goods according to claim 1, wherein the shape of the spacing between said symbols is different from the shape of said symbols.

5. Manufactured roll goods according to claim 1, wherein:
marks on perimeters of at least some of said symbols define a fine measurement scale.

6. Manufactured roil goods according to claim 1, wherein:
vertices of said polygons define a fine measurement scale.

7. Manufactured roll goods according to claim 1, wherein said symbols include:
symbols of a first type having a size corresponding to said gross scale; and
symbols of a second type having a size corresponding to said gross scale; and
wherein said symbols of said first type are disposed adjacent said symbols of said second type to facilitate counting of said symbols.

8. Manufactured roll goods according to claim 1, wherein:
said symbols include linear symbols; and
said linear symbols in adjacent rows have different angular orientations.

9. Manufactured roll goods according to claim 1, wherein:
said symbols are arranged in a plurality of columns and rows;
said symbols include at least two different symbols; and
each symbol has a different symbol disposed in each adjacent row.

10. Manufactured roll goods according to claim 9, wherein each symbol has a different symbol disposed in each adjacent column.

11. Manufactured roll goods according to claim 9, wherein said symbols include closed curves and polygons.

12. Manufactured roll goods according to claim 1, wherein at least some of said symbols have a height and a width that is not the same as said height.

13. Manufactured roll goods according to claim 12, wherein said symbols include closed curves and polygons.

14. Manufactured roll goods according to claim 1, wherein at least some of said symbols are polygons.

15. Manufactured roll goods comprising:
a pliable substrate;
a leading edge across the width of said roll goods;
a side edge along the long dimension of said roll goods;
a front surface; and
a rear surface having fiducial markings thereon, said fiducial markings including an array of symbols, at least a portion of peripheral edges of said symbols being spaced apart from peripheral edges of adjacent symbols, and wherein
a pitch of said array defines a gross measurement scale;
said fiducial markings are substantially free of grid lines;
at least some of said symbols are closed curves and some of said symbols are polygons;
said array of symbols includes rows of said symbols alternating between said closed curves and said polygons;
said array of symbols includes columns alternating between said closed curves and said polygons;
one or the other of said closed curves or said polygons include an inner symbol disposed within said closed curves or said polygons;
said inner symbols are concentric with said symbols in which they are disposed; and
said inner symbols are roughly one-third the size of said gross scale.

16. Manufactured roll goods according to claim 15, wherein said closed curves or said polygons are roughly two-thirds the size of said gross scale.

17. Manufactured roll goods according to claim 1, wherein said array includes symbols of different sizes arranged in rows at the pitch of said array.

18. Manufactured roll goods according to claim 1, wherein said array includes symbols of different sizes arranged in columns at the pitch of said array.

19. Manufactured roll goods according to claim 18, wherein said array includes symbols of different sizes arranged in rows at the pitch of said array.

20. Manufactured roll goods according to claim 19, wherein said symbols of different sizes are arranged in said array such that adjacent symbols in rows and columns have different sizes.

21. Manufactured roll goods according to claim 1, wherein said array includes symbols having different shapes.

22. Manufactured roll goods according to claim 21, wherein said array includes a uniform column or row along an edge of said roll goods, said symbols of said uniform column or row all having the same size and shape.

23. Manufactured roll goods according to claim 1, wherein the pitch of said array is at least one-eighth of the width of said rear surface.

24. Manufactured roll goods according to claim 23, wherein the pitch of said array is at least one-sixth of the width of said rear surface.

25. Manufactured roll goods according to claim 24, wherein the pitch of said array is at least one-fourth of the width of said rear surface.

26. Manufactured roll goods comprising:

a pliable substrate;

a leading edge across the width of said roll goods;

a side edge along the long dimension of said roll goods;

a front surface; and a rear surface having fiducial marking thereon, said fiducial markings including an array of symbols, at least a part on of peripheral edges of said symbols being spaced apart from peripheral edges of adjacent symbols; and wherein a pitch of said array defines a gross measurement scale;

said fiducial markings are substantially free of grid lines;

said symbols are arranged in a plurality of columns along said long dimension of said array;

said symbols in adjacent columns of said array have varying lengths; and said length of said symbols in a particular column of said array is a multiple of the length of said symbols in another column of said array.

27. Manufactured roll goods according to claim 26, wherein said multiple is two.

28. Manufactured roll goods according to claim 1, wherein said height of said polygon defines a fine measurement scale.

29. Manufactured roll goods according to claim 15, wherein said inner symbols define a fine measurement scale.

30. Manufactured roll goods according to claim 1, wherein said symbols include a fine measurement scale along said width of said roll goods.

* * * * *